US005188884A

United States Patent [19]

Smith

[11] Patent Number: 5,188,884

[45] Date of Patent: Feb. 23, 1993

[54] WOVEN PAPERMAKING FABRIC HAVING LOW PROFILE SEAM

[75] Inventor: Richard W. Smith, Greenville, S.C.

[73] Assignee: Wangner Systems Corporation, Greenville, S.C.

[21] Appl. No.: 726,755

[22] Filed: Jul. 8, 1991

[51] Int. Cl.[5] ..... B32B 23/02

[52] U.S. Cl. ..... 428/193; 139/383 AA; 156/148; 156/308.2; 162/902; 162/904; 428/121; 428/223; 428/257; 428/296; 428/192

[58] Field of Search ..... 139/383 AA; 428/121, 428/222, 223, 257, 296, 192, 193; 162/DIG. 1, 358; 156/308.2, 148

[56] References Cited

U.S. PATENT DOCUMENTS

| | | | |
|---|---|---|---|
| 4,026,331 | 5/1977 | Lees et al. | 139/383 AA |
| 4,286,631 | 9/1981 | Strandly | 139/383 AA |
| 4,438,789 | 3/1984 | MacBeam | 139/383 AA |
| 4,469,142 | 9/1984 | Harwood | 139/383 AA |

*Primary Examiner*—James J. Bell
*Attorney, Agent, or Firm*—Cort Flint; Henry S. Jaudon

[57] ABSTRACT

A papermaking fabric formed of warp and weft yarns woven endless in a multi-layer uneven weave pattern and heat set to produce set floats in the warp yarns of one length which appear on one surface of the fabric and floats of a different length which appear on a second surface of the fabric. A low profile seam for joining opposite ends of the fabric to form an endless papermaking fabric. The seam is formed by turning warp yarns back and reweaving them lengthwisse into each of the ends with weft yarns in such a manner as to present appropriate ones of the floats on appropriate fabric surfaces. At the same time, loops are formed along the ends in spaced manner. The weft adjacent the end comprise undersized yarns which are woven with the warp yarns to provide longitudinal space along the warp yarns and between the undersized weft yarns. This allows the formation of small loops at the ends by crowding the small weft yarns.

14 Claims, 1 Drawing Sheet

WOVEN PAPERMAKING FABRIC HAVING LOW PROFILE SEAM

BACKGROUND OF THE INVENTION

Papermaking fabrics are woven in any number of weave patterns to include patterns for single layer and multi-layer fabrics. Normally, these fabrics are woven endless, cut to length, and a joining seam is formed on each end.

Always of primary importance with papermaking fabrics is wearability, uniform permeability, and evenness or smoothness of the paper sheet support surface. Good wearability produces longer run times and therefore more economy. Uniform permeability allows for even drying which produces a consistent paper sheet. Finally, an even or smooth support surface prevents marks from being formed on the paper product.

Joining seams, while always presenting somewhat of a problem in allowing the papermaking fabric to retain the above characteristics, the problem has not been unsurmountable in most instances. U.S. Pat. Nos. 4,026,331; 4,883,096; and 4,976,293 show various techniques employed to form satisfactory seams in single-ply forming fabrics. Because these fabrics are single-ply, the solutions taught do not necessarily apply to multi-ply fabrics.

U.S. Pat. Nos. 4,186,780; 4,286,631; 4,438,789; and 4,469,142 disclose various solutions to forming joining seams for use with multi-ply fabrics. The basic problem exists because the warp yarns are heat-set after weaving which results in their retaining the crimp structure of the woven fabric. In multi-layer fabrics, this is not a problem as long as the weave is balanced. U.S. Pat. Nos. 4,469,142; 4,286,631; and 4,136,780 show such an even weave structure. Here, using '142 as illustrative, floats 62, 66 of equal size are formed on each fabric face. When forming the seaming loop by weaving back the warp yarns, the surface on which float 62 or 66 appears, is of no great consequence as they are evenly configurated. A smooth, evenly porous seam area is formed.

When forming a seam with an uneven weave, as shown in U.S. Pat. No. 4,438,789, the circumstances are different. The floats appearing on the top surface are of a different length than those appearing on the lower surface. Here, the solution was to disregard the crimp configuration of the warp and to weave them back regardless. This solution produces a rough surface at the seam which marks the paper sheet and also produces uneven permeability.

Another solution is to not turn back the warp until it will properly match up. This solution produces an excessively large pintle receiving loop which allow excessive open area. This arrangement also requires a large pintle which causes the looped warp to extend above the plane of the fabric which produces excess wear.

The object of the present invention is to overcome the drawbacks of the prior seam structures as noted above.

Another object of the invention is to provide, in multi-layer fabrics having uneven weaves, a loop size which fittingly accommodates a small diameter pintle.

Another object of the invention is to provide a smooth support surface in the area of the seam.

Another object of the invention is to maintain a consistent permeability profile throughout the fabric body.

Another object of the invention is to maintain a low profile in the seam so as to reduce wear of the fabric and marking of the paper sheet.

SUMMARY OF THE INVENTION

A papermaking fabric formed of warp and weft yarns woven endless in a multi-layer uneven weave pattern. The fabric is heat set which produces set floats in the warp yarns of one length which appear on one surface of the fabric and floats of a different length which appear on a second surface of the fabric.

A low profile seam is provided for joining opposite ends of the fabric so as to form an endless papermaking fabric. The seam includes warp yarns which have been turned back and rewoven lengthwise into respective of the ends of the fabric with weft yarns in a manner to present appropriate ones of the floats on appropriate fabric surfaces. The turned back warp yarns form loops along the ends which are spaced by non-loop areas. There are provided a plurality of undersized weft yarns adjacent the ends which are woven with the warp yarns to provide longitudinal space along the warp yarns and between the undersized weft yarns. This allows small loops to be formed at the ends by crowding the small weft yarns.

A papermaking fabric formed of warp yarns crimp set into crimp lengths and weft yarns woven in a multi-layer uneven weave. A crimp length is equal to one repeat of the weave pattern and are shaped to consist of a float which is arranged on the upper surface and a crimp arranged on the lower surface of the fabric. A first adjacent pair of warp yarns are arranged across the fabric. The first warp yarn of the first pair terminates with its end a short distance from an end of the fabric. A second warp yarn of the first pair is folded back and woven parallel to the first pair of warp yarns to maintain the floats and crimps on respective surfaces to a point to where its end abuts the end of the first warp yarn of the first pair of warp yarns.

A second adjacent pair of warp yarns are arranged intermediate the first pair of warp yarns arranged across the fabric. A first warp yarn of the second pair of warp yarns terminates with its end a short distance from the end of the fabric. A second warp yarn of the second pair of warp yarns is folded back and woven parallel with the second pair of warp yarns to maintain the floats and the crimps on respective surfaces to a point where its end abuts the end of the first warp yarn of the second pair of warp yarns. The second pair of warp yarns form a finished edge at the end of the fabric.

A papermaking fabric utilizing a plurality of weft yarns adjacent its end which are of less diameter than the remainder of the weft yarns. These weft yarns have a diameter of between 0.3 and 0.5 mm while the remaining of the weft yarns have a diameter of between 0.5 and 0.8. The weft yarns allow the formation of a loop at the end of the fabric capable of accommodating a pintle of between 0.6 and 0.8 mm.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

A low profile joining seam for use with dryer fabrics can be seen in FIGS. 2–5 of the drawings.

Figure 3:
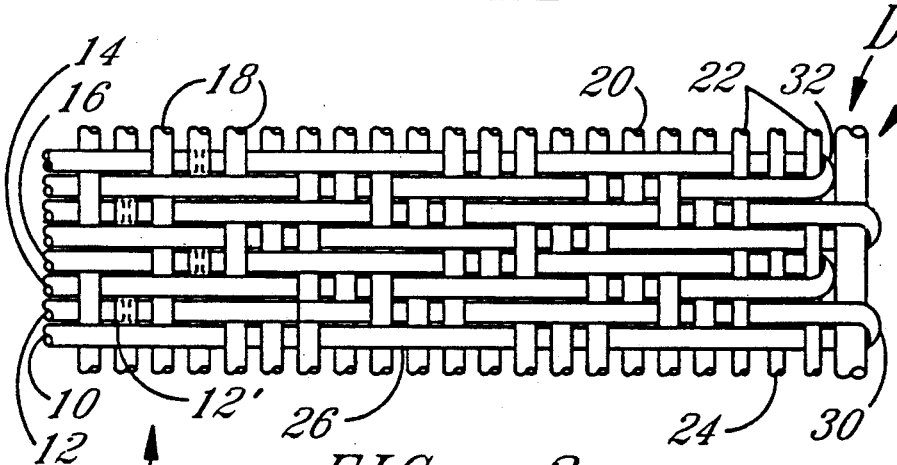
FIG. 3 is a top sectional view of the low profile seam at one end of the fabric.
Figure 4:
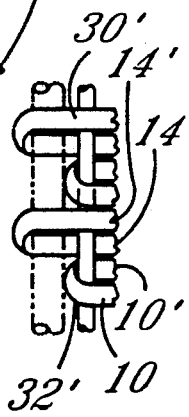
FIG. 4 is a top sectional view showing the meshing relationship between opposite ends of the fabric.

The papermaking fabric shown by way of example is an uneven weave pattern. The fabric is woven in a two-ply, two up, one down twill. The base fabric is woven with warp yarns 10, 12, 14, 16 weaving over two upper weft yarns 18 to form an upper float 26. The warp yarn then moving downwardly into the fabric to weave over a lower weft 20, then under an upper weft 18 and finally under lower weft 20 to form lower knuckle 28. The warp then moves upwardly passing under upper weft 18 and over lower weft 20 until it again appears on the upper surface of the fabric. The floats 26 appear on the upper or support surface of the fabric and form a twill pattern, as seen in FIG. 3, which presents a smooth, even surface for the paper sheet. There are four warp yarns and eight weft insertions per repeat of the weave pattern.

Figure 1:
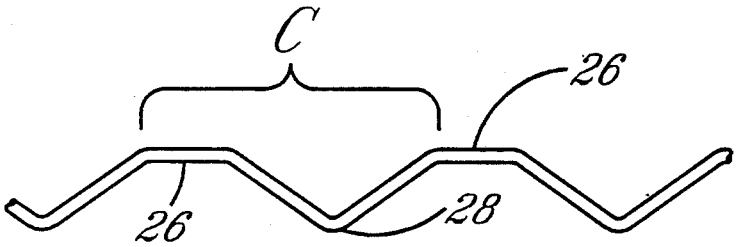
FIG. 1 is a side sectional view of a crimped filament as configured by the weave pattern shown in FIGS. 2 and 5.

After weaving, the fabric is stabilized by being placed under tension and heat-set. This permanently shapes the warp and weft yarns in the configurations created by the weave pattern. FIG. 1 shows a section of a warp yarn configured to have floats 26 and knuckles 28. That section, designated as C, represents a crimp length which is that length of warp necessary to weave a pattern repeat.

As is usual after weaving, dryer fabric A is cut to length exposing opposite ends. The weft yarns 18, 20 are removed inwardly up to between two and three inches from the end of the fabric. Alternate warp yarns are then cut so that they randomly retain only a portion of the two to three inch length.

At this point, additional weft yarn is re-woven with warp yarns 10–16. Warp yarns 12 and 16 terminate prior to the edge being reformed, as shown at 12' and 16' in FIG. 3. Warp yarns 10 and 14 continue to be woven with the additional weft yarns until the fabric end is reached. Warp yarns 10 and 14 are then turned on themselves usually by means of a small turning wire and woven back into the fabric end, as shown at 10' and 14'. Warp end 10' and 14' are woven parallel with themselves and warp yarns 12 and 16 until they substantially abut ends 12' and 16'. This procedure is further described in U.S. Pat. Nos. 4,026,331; 4,286,631; 4,438,789; and 4,469,142.

Because the weave of fabric A is uneven, in order to provide that floats 26 appeared only on the top surface and crimps 28 appeared on the lower surface, it has been necessary to turn the warp back between crimp lengths C. If the turn is made immediately, a very small loop 30 which will not accept a pintle as small as 0.6 to 0.8 mm is formed. On the other hand, if a full crimp length is exposed prior to the turn, an extremely large loop 30 which requires a very large diameter pintle is formed. This creates a gap between the fabric ends which disrupts the uniformity of permeability of the fabric. The large pintle also increases the profile of the seam which increases wear, causes marks in the paper product, and allows uneven permeability which causes uneven drying.

Figure 2:
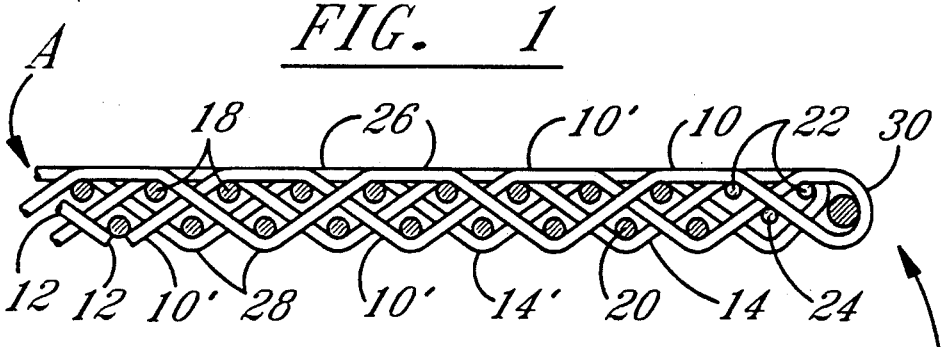
FIG. 2 is a side sectional view of the low profile seam showing a warp forming a joining loop.
Figure 5:
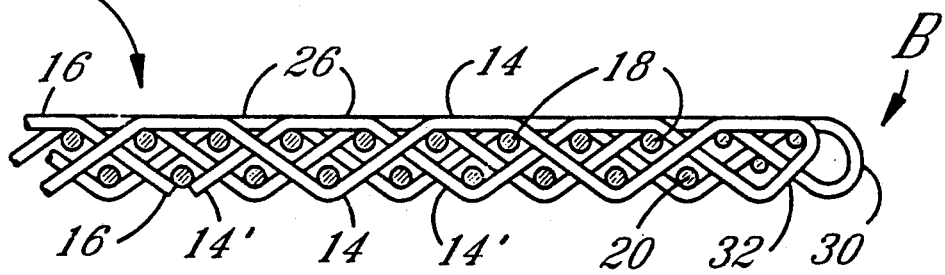
FIG. 5 is a side sectional showing an intermediate non-looped warp relative to the fabric end.

The solution to this problem is shown in FIGS. 2, 3, and 5 wherein in the selection of the additional weft yarns, at least the end most three shown at 22, 24, are of substantially less diameter than the remainder of said additional weft yarns which are of a diameter equal that of the remainder of the weft yarns. A preferred diameter for weft yarns 22, 24 is 0.4 mm as compared with 0.6 mm for the remainder of weft yarns 18, 20. Of course, the number of smaller diameter weft yarns is dependent upon the weave pattern and the size necessary for the loop. Various numbers of small weft ranging from a fraction of a repeat of the weave pattern to a full repeat of the weave pattern may be used.

The seam shown in FIG. 3 is formed by weaving warp yarns 10 with weft yarns 22, 24, turning each warp yarn 10 about a small turning wire at knuckle 20, and weaving portion 10' back through weft yarns 22, 24, 18, and 20 until it abuts end 12'. Because of the lesser diameter of weft yarns 22, 24, space exist lengthwise along warp 10, 10', 14, and 14' and also vertically above and below the weft 22, 24. When a small pintle D is inserted into loops 30, the weft yarns 22, 24 are compressed lengthwise of warp yarns 10–16 while at the same time these same warp yarns are drawn vertically inward creating the small but sufficient opening of loop 30. Because of the smallness of the loop, the permeability profile of the seam is consistent with that of the fabric body. Also, because of the smallness of the pintle and associated small weft yarns the outer profiles of the seam do not exceed that of the fabric thus eliminating potential unusual wear and unwanted markings of the paper sheet.

Warp yarn 14 is turned back also and portion 14' is woven back through weft yarns 22, 24, 18, and 20 until it abuts end 16' as shown in FIG. 5. No loop is formed as warp yarn 14 is not turned about a turning wire. This allows for the formation of non-loop portions 32.

As is usual, on the opposite end of the fabric, loops 30' are formed of warp yarns 14 and intermediate non-loop areas 32' are formed of warp yarns 10. When the fabric ends are brought together, loops 30 engage in recesses created by non-looped portions 32' and loops 30' engage in recesses created by non-looped portions 32 so that loops 30, 30' are arranged to alternately receive pintle D.

The composition of the yarns forming fabric A and seam B does not form a part of the invention. It is, however, preferred that said yarns be composed of suitable synthetic monofilaments. Synthetic yarns of polyamid, polyester, polyethylene and blends thereof are commonly employed to form papermaking fabrics.

While a preferred embodiment of the invention has been described using specific terms, such description is for illustrative purposes only, and it is to be understood that changes and variations may be made without departing from the spirit or scope of the following claims.

What is claimed is:

1. A papermaking fabric formed of warp and weft yarns woven endless in a multi-layer uneven weave pattern and heat set to produce set floats in said warp yarns of one length which appear on one surface of said fabric and set floats of a different length which appear on a second surface of said fabric;

a low profile seam is provided for joining opposite ends of said fabric to form said endless papermaking fabric;

said seam including warp yarns turned back and rewoven lengthwise into opposite respective of ends with said weft yarns to present appropriate ones of said floats on appropriate fabric surfaces and to form loops along said ends which are spaced by non-loop areas, the improvement comprising;

providing a plurality of undersized weft yarns adjacent said ends which are woven with said warp yarns to provide longitudinal space along said warp yarns and between said undersized weft yarns, whereby small loops are formed at said ends by crowding said small weft yarns.

2. The seam as set forth in claim 1 wherein the number of undersized weft yarns is equal to half the number of weft yarns in said weave pattern.

3. The seam as set forth in claim 1 wherein the number of undersized weft yarns is equal to the number of weft yarns in said pattern.

4. The papermaking fabric of claim 1 wherein said first surface comprises a support surface, said floats appearing on said first surface are longer than said floats appearing on said second surface.

5. The seam of claim 1, including a pintle yarn inserted in said loops wherein the inner circumference of said loops and the outer circumference of said pintle yarn are substantially equal.

6. A papermaking fabric formed of warp yarns crimp set into crimp lengths and weft yarns woven in a multilayer uneven weave, said crimp length is equal to one repeat of the weave pattern, said crimp lengths of said warp yarns are shaped to consist of a float which is arranged on the upper surface and a crimp arranged on the lower surface of said fabric;

a first adjacent pair of said warp yarns are arranged across said fabric;

a first warp yarn of said first pair of warp yarns terminates with its end a short distance from an end of said fabric and a second warp yarn of said first pair of said warp yarns is folded back and woven parallel to said first pair of warp yarns to maintain said floats and crimps on respective surfaces to a point to substantially abut said end of said first warp yarn of said first pair of warp yarns, said first pair of warp yarns forming a loop at said end of said fabric;

a second adjacent pair of warp yarn intermediate said first pair of warp yarns and arranged across said fabric;

a first warp yarn of said second pair of warp yarns terminates with its end a short distance from said end of said fabric and a second warp yarn of said second pair of warp yarns is folded back and woven parallel with said second pair of warp yarns to maintain said floats and said crimps on respective surfaces to a point to substantially abut said end of said first warp yarn of said second pair of warp yarns, said second pair of warp yarns forming a finished edge at said end; and said loop comprising only a portion of a crimp length.

7. The papermaking fabric of claim 6 wherein a plurality of weft yarns adjacent said end are of less diameter than the remainder of said weft yarns.

8. The papermaking fabric of claim 7 wherein each of said plurality of weft yarns has a diameter of between 0.3 mm and 0.5 mm.

9. The papermaking fabric of claim 8 wherein each of the remaining of said weft yarns has a diameter of between 0.5 mm and 0.8 mm.

10. The papermaking fabric of claim 6 wherein said loop is capable of accommodating a pintle of between 0.6 mm and 0.8 mm.

11. A method of forming a low-profile seam for a multi-layered papermaking fabric which has been woven in an uneven weave in which warp yarns pass over a plurality of upper weft yarns and under a lesser number of lower weft yarns in each repeat of said pattern;

said warp yarns being heat set so as to be permanently set in configurations forming a plurality of crimp lengths, each representative of a repeat of said pattern, said method including:

cutting said fabric to a length having opposed ends;

removing a predetermined number of weft yarns from an end of said fabric so that said warp yarns extend beyond said end;

cutting alternate of said warp yarns to a length shorter than said intermediate warp yarns;

re-weaving said warp yarns with additional weft yarns until only said intermediate weft yarns extend beyond said end, said alternate weft yarns terminating short thereof;

turning said intermediate warp yarns back and weaving parallel said warp yarns until ends of said intermediate yarns abut ends of said alternate yarns;

causing said crimp lengths to be arranged to present said portions through which pass over a plurality of weft yarns in proper position and those portions which pass over a lesser number of weft yarns in proper position, and forming small loops in alternate turns of said warp yarns capable of receiving a seaming pintle.

12. The method of claim 11 including the method of providing that certain of said additional weft are of a lesser diameter than the remainder of said weft yarns.

13. The method of claim 12 including the method of arranging said additional weft of lesser diameter adjacent said end whereby space is created longitudinally of the warp and vertically of the weft.

14. The method of claim 13 including the step of inserting a seaming pintle of a diameter larger than said weft into said loops causing said upper warps to be drawn downwardly and said lower warps to be drawn upwardly against said additional weft of lesser diameter and simultaneously causing said additional weft of lesser diameter to be forced laterally along said warp thereby creating loops having an opening substantially equal to the diameter of said pintle and also forming a low profile on the upper and lower surfaces of said fabric.

* * * * *